US008744115B2

(12) United States Patent
Cha

(10) Patent No.: US 8,744,115 B2
(45) Date of Patent: Jun. 3, 2014

(54) SPEAKER

(75) Inventor: Hyunseung Cha, Seoul (KR)

(73) Assignee: LG Electronics Inc., Seoul (KR)

( * ) Notice: Subject to any disclaimer, the term of this patent is extended or adjusted under 35 U.S.C. 154(b) by 390 days.

(21) Appl. No.: 12/984,278

(22) Filed: Jan. 4, 2011

(65) Prior Publication Data

US 2012/0039476 A1 Feb. 16, 2012

(30) Foreign Application Priority Data

Aug. 12, 2010 (KR) ..... 10-2010-0077959

(51) Int. Cl.
*H04R 1/02* (2006.01)

(52) U.S. Cl.
USPC ..... 381/387; 381/304; 381/17; 181/199

(58) Field of Classification Search
USPC ..... 381/17, 87, 160, 186, 345, 333, 335, 381/89, 387, 332, 336, 386, 304; 181/148, 181/155, 198, 199
See application file for complete search history.

(56) References Cited

U.S. PATENT DOCUMENTS

| | | | | |
|---|---|---|---|---|
| 4,757,544 | A * | 7/1988 | Guy | 381/387 |
| 5,485,521 | A * | 1/1996 | Yagisawa et al. | 381/160 |
| 7,561,935 | B2 * | 7/2009 | Chung | 700/94 |
| 2004/0028240 | A1 | 2/2004 | Spinale | |
| 2008/0044050 | A1 | 2/2008 | Bhakta | |
| 2009/0196450 | A1 | 8/2009 | Hughes | |
| 2010/0027827 | A1 | 2/2010 | Tezuka et al. | |
| 2011/0115987 | A1 * | 5/2011 | Kubo | 348/738 |

* cited by examiner

*Primary Examiner* — Vivian Chin
*Assistant Examiner* — Friedrich W Fahnert
(74) *Attorney, Agent, or Firm* — Birch, Stewart, Kolasch & Birch, LLP

(57) ABSTRACT

Provided are a speaker and a speaker system. The speaker includes a main unit and a sub unit. The main unit emits a sound in a first direction. The sub unit is formed integrally with the main unit and emits a sound in a second direction different from the first direction.

5 Claims, 18 Drawing Sheets

SPEAKER

CROSS-REFERENCE TO RELATED APPLICATIONS

The present application claims priority under 35 U.S.C. 119 and 35 U.S.C. 365 to Korean Patent Application No. 10-2010-0077959, filed on Aug. 12, 2010, which is hereby incorporated by reference in its entirety.

BACKGROUND

The present disclosure relates to a speaker and speaker system, which provides a richer sound effect using a speaker having multi-directionality.

Generally, audio systems and home theaters include a speaker unit that emits sound waves using vibration of a diaphragm. Speakers are classified into tweeter speaker units emitting high-frequency sound waves, woofer speaker units emitting low-frequency sound waves, and full range speaker units emitting full-range sounds. In addition, subwoofer speaker units may be added to emphasize medium and low-pitched sounds.

The audio frequency of human ranges from about 20 Hz to about 20 KHz.

Accordingly, the frequency of sounds emitting from speakers usually ranges from about 35 Hz to about 20 KHz. For example, the frequency of sounds emitting from tweeter speakers, woofer speakers, and full-range speakers ranges from about 3 KHz to about 20 KHz, from about 150 Hz to about 5 KHz, and from about 35 Hz to about 20 KHz, respectively. In order to emphasize medium and low-pitched sounds, subwoofer speakers may be optionally added. The frequency of sounds emitting from subwoofer speakers ranges from about 35 Hz to about 150 Hz.

Here, the enclosure refers to a speaker case housing a speaker and made of wood or plastic, which is also called a cabinet or a box. Particularly, when sound waves emit using only the operation of a speaker unit without an enclosure, low-pitched sounds may not be normally replayed, or high-pitched sounds may have poor sound quality.

Accordingly, a speaker unit generally includes an enclosure that serves as a sounding box. Speakers can be classified into bookshelf-type speakers and tallboy-type speakers according to the shape of the enclosure and the installation state of speakers in the enclosure.

The bookshelf-type speakers refer to compact speakers having a small size enough to enter a bookshelf, and include speak units housed in enclosures having a height of about 30 cm to about 50 cm. The bookshelf-type speakers are used in compact audio systems or computers.

The tallboy-type speakers refer speakers in which a plurality of speaker units are linearly arranged in an enclosure having a cylindrical or square-pillar shape with a relatively higher height of about 90 cm to about 150 cm. The tallboy-type speakers are directly fixed on a floor of the interior, and include speaker units having a volume enough to obtain an immersive sound effect and connected to an output terminal of a home theater.

However, such speaker units are affected the directivity of sound waves according to the installation location of the speaker units, which becomes a factor deteriorating a sound field effect.

Also, since in a related-art tallboy-type speaker, a speaker unit emitting sound waves is installed at a predetermined angle in a baffle and enclosure, a sound field is already determined by the fabrication of a speaker, making it difficult to show various sound field effects. Accordingly, it is difficult to meet demands of audience.

SUMMARY

Embodiments provide a speaker having multi-directivity, and implementing a pitch meeting demands of audience by causing a change of the directivity of sound waves emitting from one speaker unit.

In one embodiment, a speaker includes: a main unit emitting a sound in a first direction; and a sub unit formed integrally with the main unit and emitting a sound in a second direction different from the first direction.

In another embodiment, a speaker includes: a first enclosure; a first speaker unit housed in the first enclosure to output a sound in a first direction; a second enclosure seated on one side of the first enclosure; and a second speaker unit housed in the second enclosure to output a sound in a second direction different from the first direction.

In further another embodiment, a multi-channel speaker system includes a plurality of speakers, each of the speakers including: a main unit outputting a sound in a first direction; and a sub unit integrally formed with the main unit and outputting a sound in a second direction different from the first direction.

According to a speaker and speaker system according to an embodiment of the present invention, a sound field effect can be anticipated in consideration of the ambient environments of a listener, and a more immersive sound effect can be provided, by generating sounds having multi-directivity using one speaker.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

A speaker and speaker system according to an embodiment will be described in detail with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure can easily be derived through adding, altering, and changing, and will fully convey the concept of the invention to those skilled in the art.

The meaning of "include," "comprise," "including," or "comprising," specifies a property, a region, a fixed number, a step, a process, an element and/or a component but does not exclude other properties, regions, fixed numbers, steps, processes, elements and/or components.

Figure 1:
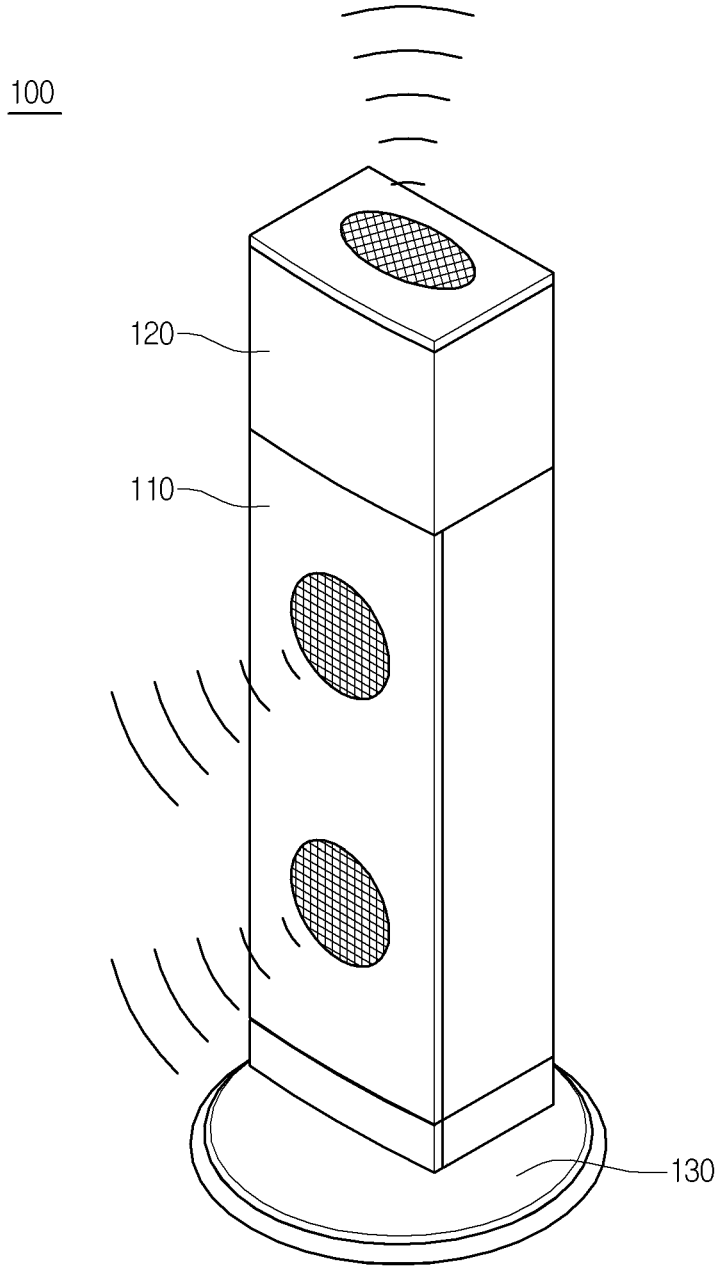
FIG. 1 is a perspective view illustrating a speaker according to an embodiment of the present invention.

FIG. 1 is a perspective view illustrating a speaker according to an embodiment of the present invention.

Referring to FIG. 1, a speaker 100 may include a main unit 110 outputting a sound in a first direction, a sub unit 120 formed integrally with the main unit 110 and outputting a sound in a second direction different from the first direction, and a supporting unit 130 supporting the main unit 110 and the sub unit 120.

Also, the main unit 110 may include a main unit that converts electrical signals received from an audio system into acoustic signals and outputs the acoustic signals in the first direction. The sub unit 120 may include a sub unit that converts electrical signals received from the audio system into acoustic signals and outputs the acoustic signals in the second direction.

As illustrating in FIG. 1, the main unit 110 may be installed to face the front side, and may output sounds toward the front side. Accordingly, the first direction may be the frond side of the speaker 100.

Also, the sub unit 120 may be installed to face the upper side, and may output sounds toward the upper side according to the installation direction. Accordingly, the second direction may be the upper side of the speaker 100.

In this case, the acoustic signals outputted from the main unit 110 and the sub unit 120 may be identical to each other (acoustic signal having the same channel), but may have different output direction.

The undersurface of the sub unit 120 may be coupled to the top surface of the main unit 110, but the direction of the sub unit 120 may be adjustable. A detained description of a coupling portion between the main unit 110 and the sub unit 120 will be described below.

Figure 4:
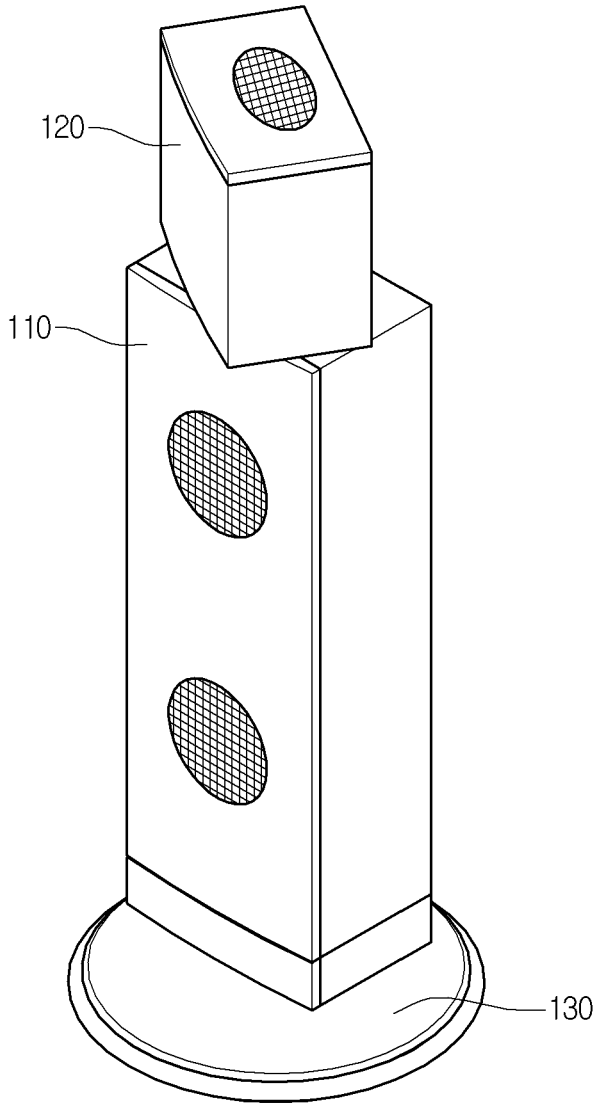
FIG. 4 is a view illustrating a sub unit horizontally moving in a speaker according to an embodiment of the present invention.
Figure 6:
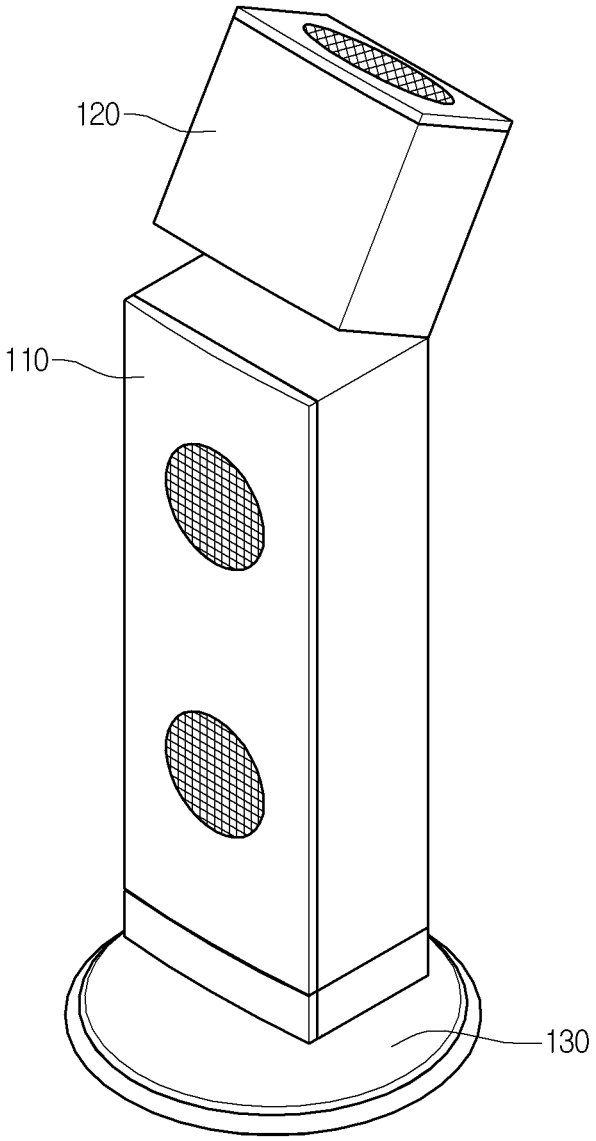
FIGS. 6 and 7 are views illustrating a sub unit moving in a vertical direction.
Figure 7:
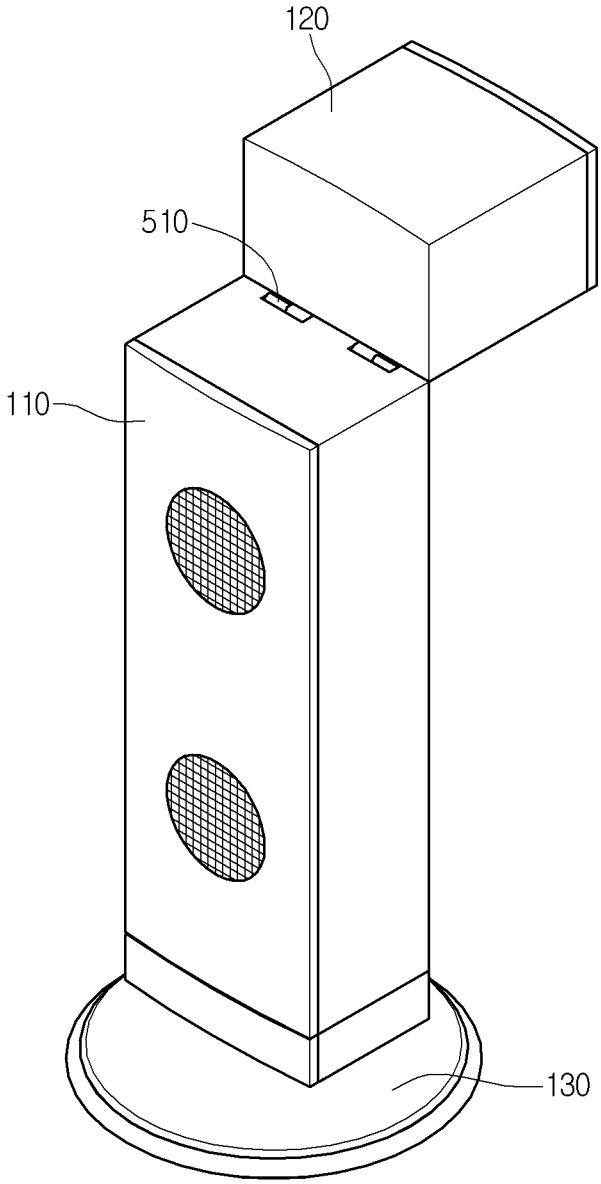

As illustrating in FIGS. 4, 6, and 7, the sound-emitting direction of the sub unit 120 may be adjusted by a user. Accordingly, the sub unit 120 stacked on the main unit 110 may not only occupy a relatively smaller space, but also the sound-emitting direction may be adjusted by a user, thereby providing a richer sound field effect.

Hereinafter, a more detailed description of the speaker 100 will made with reference to the accompanying drawings.

Figure 2:
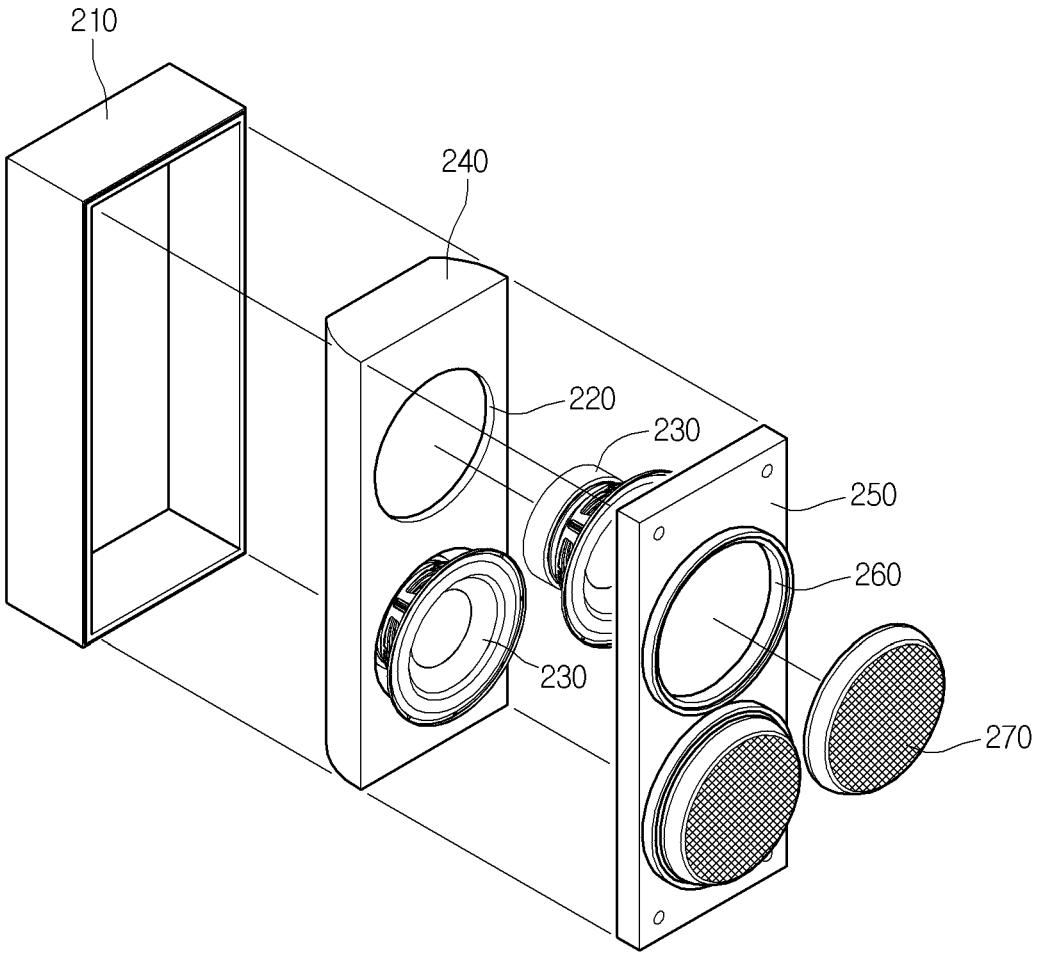
FIG. 2 is an exploded view illustrating a main unit.
Figure 3:
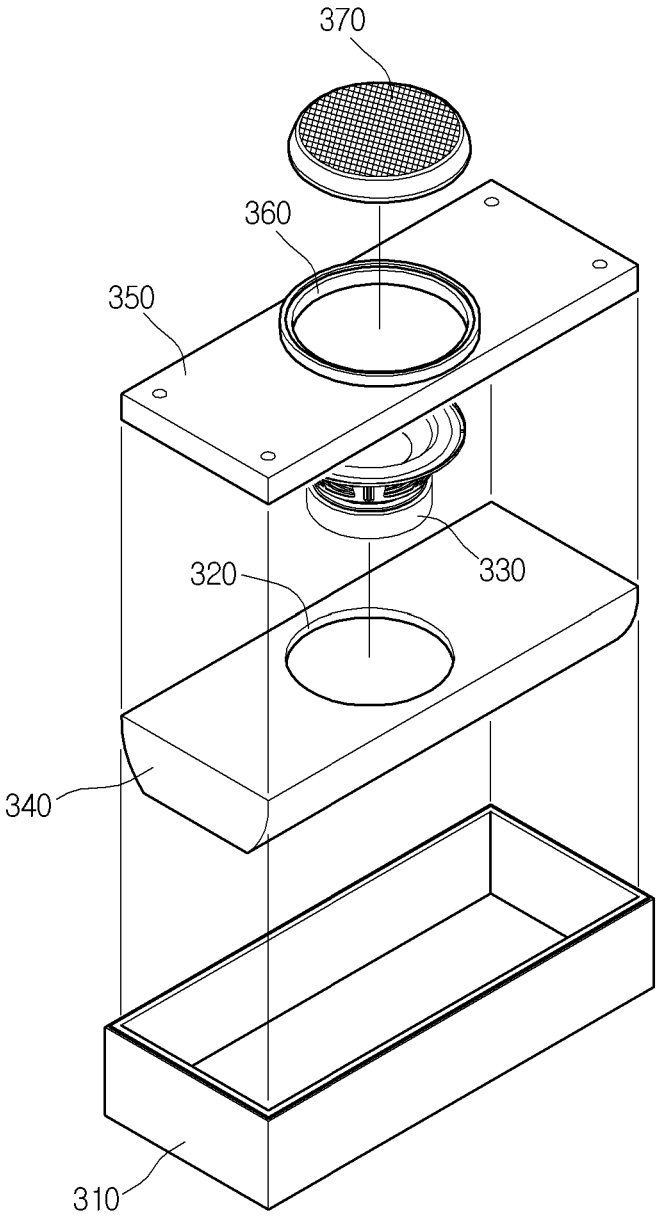
FIG. 3 is an exploded view illustrating a sub unit.

FIG. 2 is an exploded view illustrating the main unit 110. FIG. 3 is an exploded view illustrating the sub unit 120.

Referring to FIG. 2, the main unit 110 may include a plurality of speaker units 230 that are arranged in a row in a main enclosure 210. The main enclosure 210 may have a square-pillar shape, one side of which is opened. A baffle 240 including the plurality of main units 230 may be fixed toward the one side.

Also, a front panel 250 may be coupled to the main enclosure 210 at the front surface of the baffle 240 to form a front appearance of the speaker. A plurality of grill caps 270 may be assigned to the plurality of main units 230 to protect the main units 230. The grill caps 270 may be fixed on the front panel 250 to allow the speaker to be straight on an installation place (floors of the interiors and living rooms) to be electrically connected to audio systems.

To more specifically explain, the main units 230 may be disposed in the main enclosure 210 in a row, and the main units 230 may include tweeter speaker units emitting high-frequency sounds, woofer speaker units emitting low-frequency sounds, full-range speaker emitting full-range sounds, and a combination thereof.

In this case, the main enclosure 210 may be hollow to appropriately echo sound waves emitting toward the read side of the main unit 230. The main enclosure 210 may have a substantially rectangular pillar shape and an opened one side to allow the plurality of main units 230 to be disposed at the opened one side.

The main units 230 may be fixed in the baffle 240 having the insertion holes 220, respectively. The baffle 240 may serve as a shield plate for preventing sound waves emitting from the front surface and the rear surface of the diaphragm of the main unit 230 and having phases different from each other from being interfered with and offset by each other. The insertion holes 220 fit for the rear surface of the main units 230 may be provided in the baffle 240. The diaphragms of the main units 230 may be inserted and fixed in the insertion holes 220 to face forward.

That is, the baffle 240 may support the plurality of main units 230 to be housed in the main enclosure 210, and may block undesired sound waves emitting toward the rear side of the main units 230 to facilitate the improvement of the sound quality.

A front panel 250 including a plurality of sound-emitting holes 260 may be disposed toward the front side of the baffle including the main units 230 to be coupled to the main enclosure 210. Accordingly, sound waves emitting from the diaphragm of the main unit 230 may be propagated to audience through the sound-emitting hole 260 of the front panel 250.

Referring to FIG. 3, the sub unit 120 may have the same components as the main unit 110. However, the direction of the sub unit 330 provided in the sub unit 120 may be different from that of the main unit 110.

That is, the sub unit 120 may include a baffle having a sub unit 330 fixed at an opened side of a sub enclosure 310.

Also, a top panel 350 may be fixed on the top surface of the baffle 340 in the sub enclosure 310 to form the appearance of the top surface of the speaker. A grill cap 370 may be assigned to the sub unit 330 to protect the sub unit 330. The grill cap 370 may be fixed on the front panel 350 to allow the speaker to be straight on an installation place (floors of the interiors and living rooms) to be electrically connected to audio systems.

In this case, the sub enclosure 310 may be hollow to appropriately echo sound waves emitting toward the lower side of the sub unit 330. The sub unit 330 may be fixed in the baffle 340 having the insertion holes 320. The baffle 340 may serve as a shield plate for preventing sound waves emitting from the front surface and the rear surface of the diaphragm of the sub unit 330 and having phases different from each other from being interfered with and offset by each other. The insertion hole 320 fit for the rear surface of the sub unit 330 may be provided in the baffle 340. The diaphragms of the sub unit 330 may be inserted and fixed in the insertion hole 320 to face upward.

As a result, a top panel 350 including a sound-emitting hole 360 may be disposed on the top surface of the baffle including the sub unit 330 to be coupled to the sub enclosure 310. Accordingly, sound waves emitting from the diaphragm of the sub unit 330 may be propagated to audience through the sound-emitting hole 360 of the top panel 350.

FIG. 4 is a view illustrating a sub unit horizontally moving in a speaker according to an embodiment of the present invention.

Referring to FIG. 4, a sub unit 120 may move in the horizontal direction, based on a main unit 110 that is fixedly installed.

In this case, if the sub unit 120 has a rectangular parallelepiped shape as shown in FIGS. 1 and 3, the substantial direction of sound does not change even though the sub unit 120 rotates in the horizontal as described above.

However, the shape of the sub unit 120 shown in FIGS. 1 and 3 may merely correspond to one example. Accordingly, the sub unit 120 may be formed to have a trapezoidal shape as shown in FIG. 9, or various other shapes.

A sub unit provided in the sub unit 120 may be formed within an angle range of about 45 degrees to about 90 degrees based on a main unit. The angle range may be modified by the rotation member described below.

Figure 9:
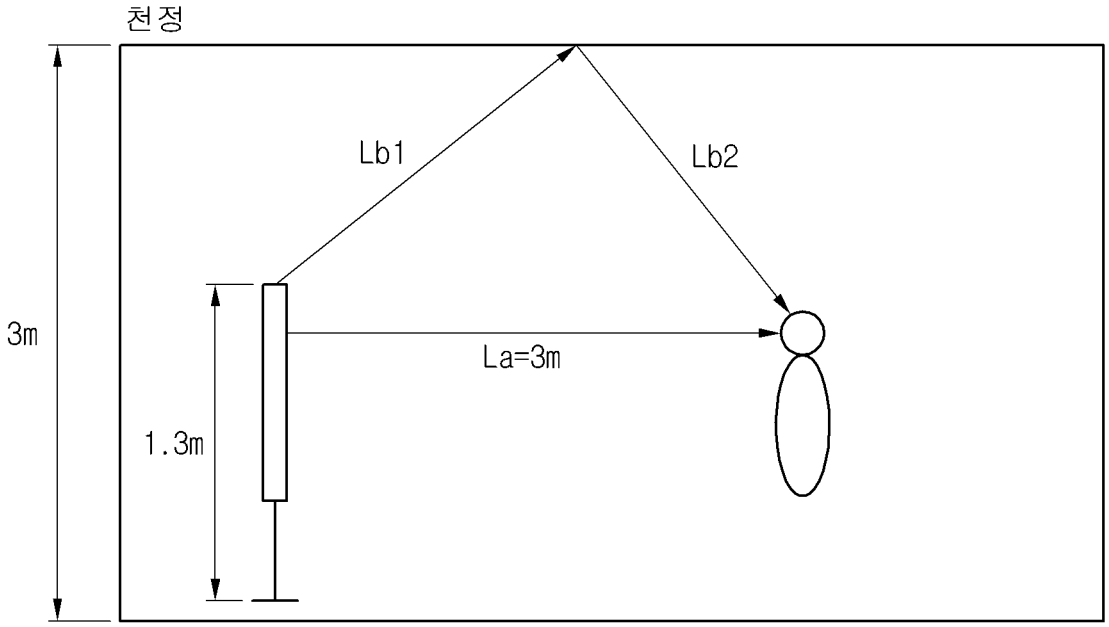
FIG. 9 is a perspective view illustrating a speaker according to another embodiment of the present invention.

That is, if the sub unit 120 has a trapezoidal shape as shown in FIG. 9, the direction of sound may change in forward/upward, left/upward, backward/upward, and right/upward directions according to the horizontal rotation of the sub unit 120.

In order to horizontally move the direction of the sub unit 120, a speaker 100 according to an embodiment of the present invention may include a first rotation member 300.

Figure 5:
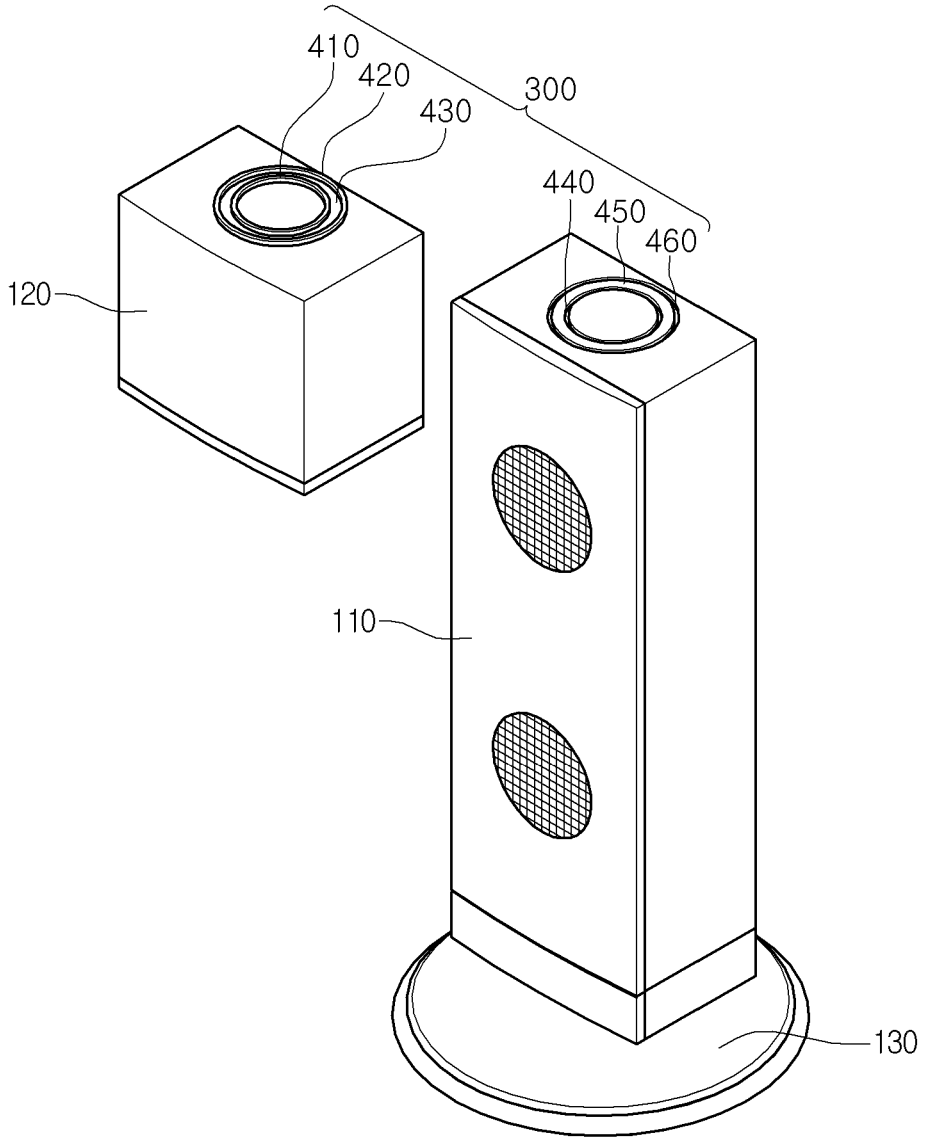
FIG. 5 is a detailed view illustrating a first rotation member according to an embodiment of the present invention.

FIG. 5 is a detailed view illustrating a first rotation member according to an embodiment of the present invention.

A first rotation member 300 may be disposed at a coupling portion between a main unit 110 and a sub unit 120. The first rotation member 300 may include a first guide groove 440 and a second guide groove 450 on the top surface of the main unit 110, and a first guide protrusion 410 and a second protrusion 420 on the undersurface of the sub unit 120.

Specifically, the first and second guide grooves 440 and 450 may have a circular-strip shape. The first guide groove 440 may have a circular-strip shape smaller than that of the second guide groove 450. A protrusion 460 of a circular-strip shape having a certain width may be formed between the first guide groove 440 and the second guide groove 450.

Similarly, the first and second guide protrusions 410 and 420 may have a circular-strip shape. The first guide protrusion 410 may have a circular-strip shape smaller than that of the second guide protrusion 420. Then, a groove 420 of a circular-strip shape having a certain width may be formed between the first guide protrusion 410 and the second guide protrusion 420.

The first guide groove 440 may be formed to have a circular-strip shape of the same size as the first guide protrusion 410, and the second guide groove 450 may be formed to have a circular-strip shape of the same size as the second guide protrusion 420

When the sub unit 120 is seated on the main unit 110, the first guide protrusion 410 may be inserted into the first guide groove 440, and the second guide protrusion 420 may be inserted into the second guide groove 450.

Accordingly, the sub unit 120 may be tightly seated on the main unit 110 using two pairs of guide grooves and guide protrusions that have circular-strip shapes.

Also, since the first and second guide grooves 440 and 450 and the first and second guide protrusions 410 and 420 have a circular-strip shape, the front surface of the sub unit 120 can rotate 360 degrees on the main unit 110 to face a certain direction.

In this case, since the rotation is guided while the protrusion 460 is contacting the groove 430, the sub unit 120 may stably rotate without being shaken or separated from the main unit 110 when the sub unit 120 when a user rotates the sub unit 120.

According to the present embodiment, since the sub unit 120 is coupled to and rotates on the main unit 110 through two pairs of guide grooves and guide protrusions, a user can easily and stably change the direction of the front surface of the sub unit 120 into a desired direction. Accordingly, the sound-emitting direction of the sub unit 120 can be adjusted.

FIGS. 6 and 7 are views illustrating a sub unit moving in a vertical direction.

As illustrated in FIGS. 6 and 7, a sub unit 120 may move in the vertical direction based on a main unit 110, and thus the direction of sound outputted through the sub unit 120 can change.

FIG. 6 is a view illustrating the sub unit 120 obliquely moving at an angle of about 30 degrees with respect to the main unit 110. FIG. 7 is a view illustrating moving at an angle of about 90 degrees with respect to the main unit 110.

The sub unit 120 may move in an oblique direction with respect to the main unit 110, and thus the direction of sound may be adjustable.

In this case, if the direction of sounds outputted through the sub unit 120, a desired sound field effect may not be achieved. Accordingly, the maximum movement range of the sub unit may fall within a symmetrical range with respect to a main unit included in the main unit 110, that is, about 180 degrees with respect to the main unit.

To this end, the present embodiment may include a second rotation member 510 to obliquely move the sub unit 120 over the main unit 110.

The second rotation member 510 may operated using a typical hinge method used in the art, and thus a detailed description of the second rotation member 510 will be omitted herein.

In this case, in order to maximize the sound field effect by a speaker according to an embodiment, the speaker may include both of the first rotation member and the second member. Accordingly, the sub unit 120 may freely rotate over the main unit 110 in a horizontal or vertical direction.

Figure 8:
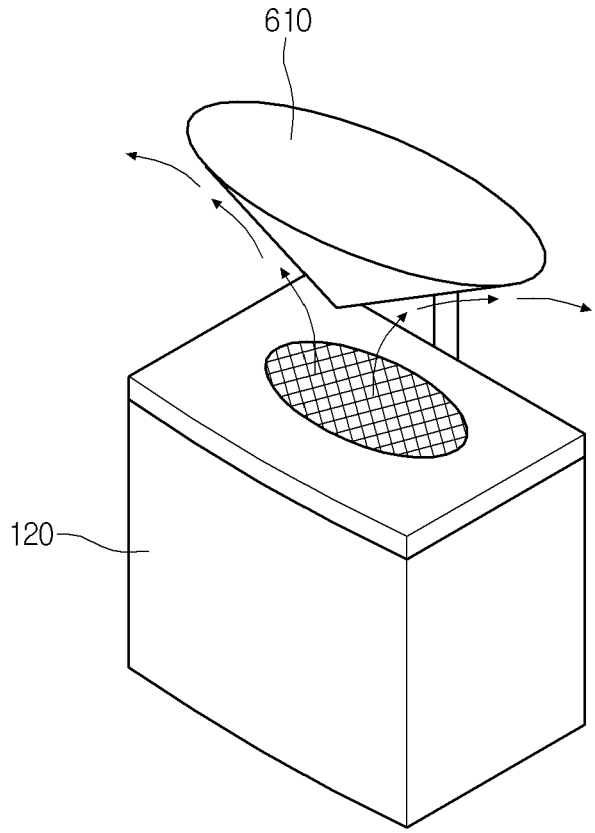
FIG. 8 is a view illustrating a reflection plate according to an embodiment of the present invention.

FIG. 8 is a view illustrating a reflection plate according to an embodiment of the present invention.

Referring to FIG. 8, a speaker according to an embodiment of the present invention may include a reflection plate 610 over a sub unit 120. The reflection plate 610 may reflect a sound outputted from the sub unit 120 to change the direction of the sound.

The reflection plate 610 may be provided to diffuse sounds outputted from the sub unit 120. In this case, the reflection plate 610 may have a cone shape as shown in FIG. 8. That is, the reflection plate 610 may be formed to have a cone shape of a certain size to improve the sound pressure level and frequency response, and the directivity of sounds outputted from the sub unit 120.

Accordingly, the directions of sounds outputted from the sub unit 120 may be changed by the reflection plate 610 like arrows shown in FIG. 8.

Figure 10:
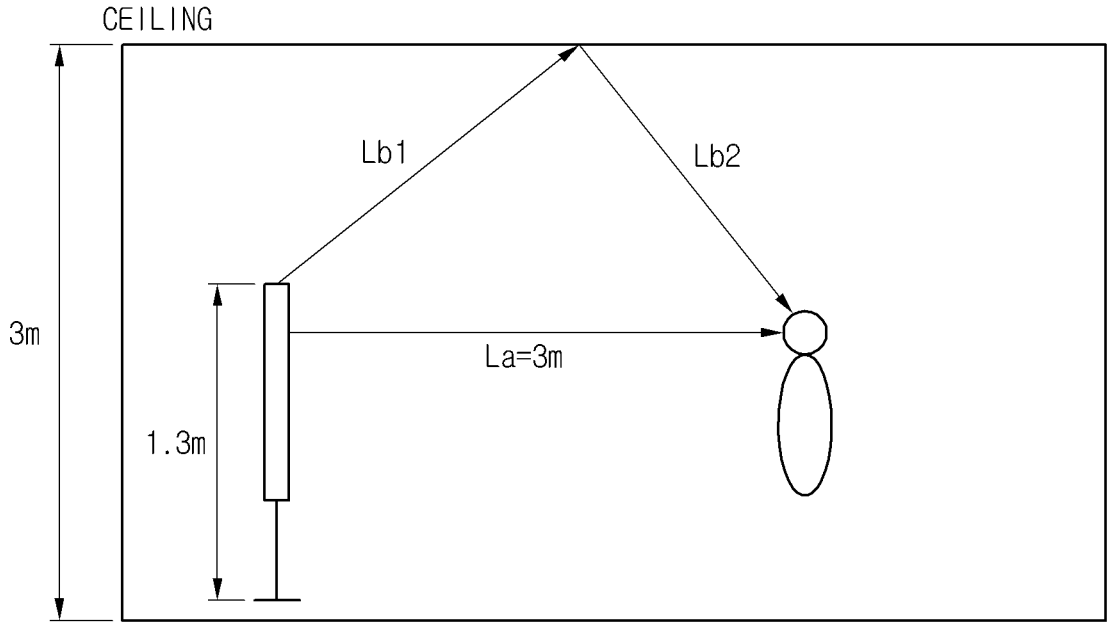
FIG. 10 is a view illustrating a delay time of a sound according to an embodiment of the present invention.

FIG. 10 is a view illustrating a delay time of a sound according to an embodiment of the present invention.

Referring to Fig. the time taken for a sound outputted from the sub unit 120 to reach audience is as follows.

In order to obtain the time, a path Lb through which the sound first reflected by the ceiling travels has to be known. Here, the path LB equals a first path Lb1 and a second path Lb2, and becomes about 4.84 m.

Since a pass length difference (PLD) is expressed as Lb−La, the pass length difference (PLD) becomes about 1.84 m that is obtained by subtracting about 3 from about 4.84.

In this case, since the velocity V of the sound is expressed as distance (S)/time (T), time (T) equals distance (S)/velocity (V). The distance (S) may be about 1.84 m, and the propagation velocity of the sound may be about 348 m/s in air, the time becomes about 5.3 ms that is obtained by dividing about 1.84 m by about 348 m/s.

As a result, there is a delay time of about 5.3 ms between a time when the sound emits from the sub unit 120 and a time when the emitted sound reaches audience.

As described above, since the sound outputted from the sub unit 120 is delayed compared to the sound outputted from the main unit 110, a more immersive sound effect than that of a related-art speaker can be delivered to a listener as if the listener was at hall.

Also, the delay time of the sub unit 120 may increase or decrease according to the direction of a sub unit provided in the sub unit 120.

According to an embodiment of the present invention, a signal processing may be performed to increase the sound pressure level of harmonic components in audio signals that are delivered to speakers in order to enhance the cubic effect of the speaker system.

Figure 11:
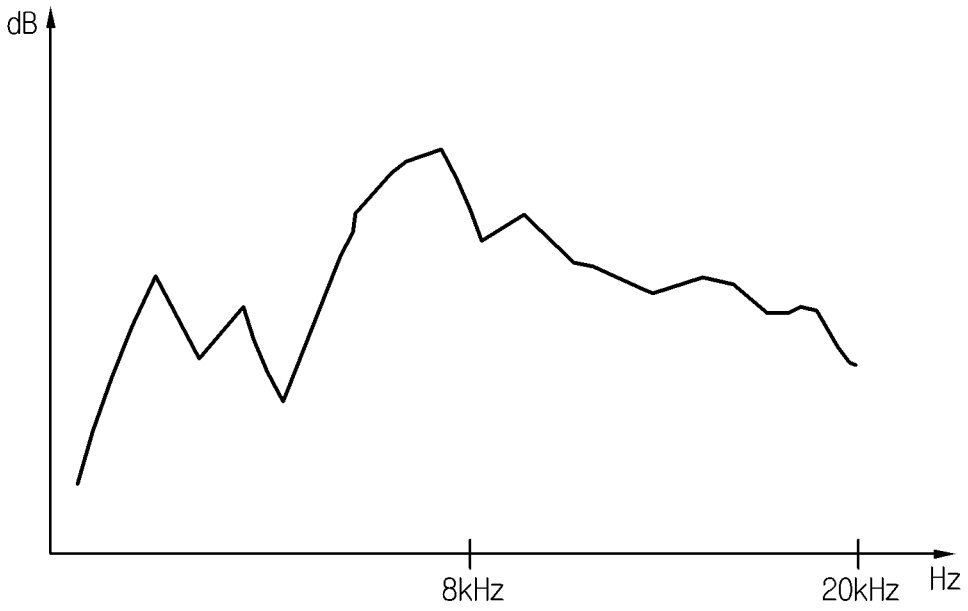
FIGS. 11 and 12 are views illustrating a harmonic processing according to an embodiment of the present invention.

FIG. 11 shows an original audio signal that is provided from an amplifier to a speaker. A single processing may be performed to increase the sound pressure level of a signal of the harmonic frequency band, for example, about 8 KHz. When the sound pressure level of a signal having a frequency of about 8 KHz increases, an audio signal like in FIG. 12 can be obtained.

When the result of increasing the harmonic component is outputted from the speaker, a user may feel a stronger effect as if the user was in a concert hall.

The reference of the harmonic signal, that is, the reference of the signal band to increase the sound pressure level may vary according to embodiments, and may be set from about 8 KHz to about 10 KHz.

The signals having passed the harmonic processing may be outputted through the main unit 110 and the sub unit 120 of the speaker 100.

The speaker 100 including the main unit 110 and the sub unit 120 may include a 5.1 channel, and 7.1 channel or 7.2 channel speaker, and may include one of the speakers described above.

Figure 13:
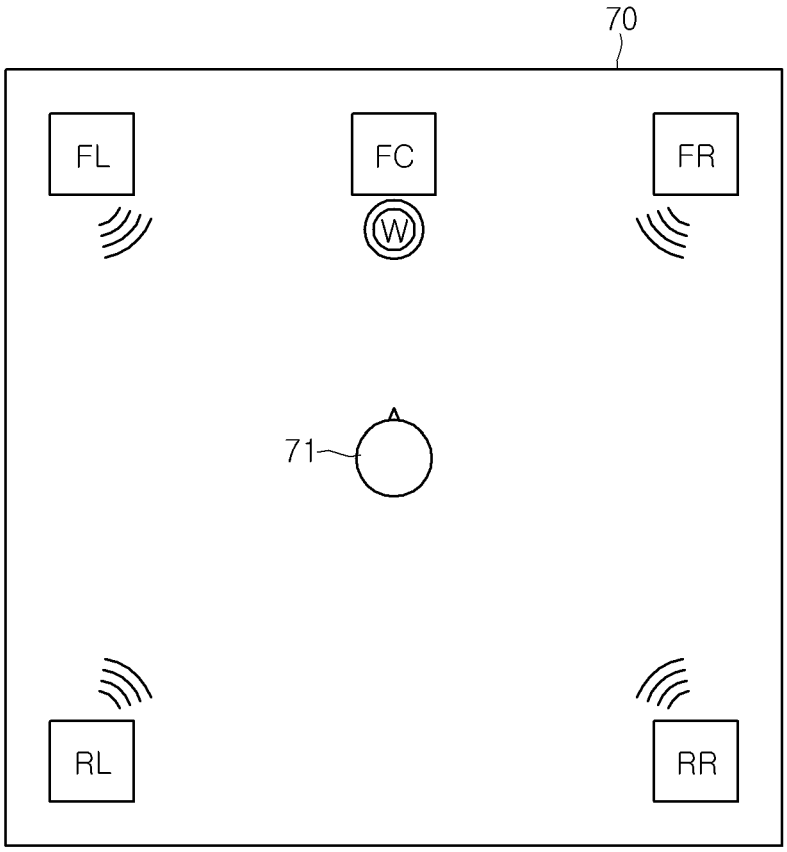
FIG. 13 is a view illustrating a 5.1 channel speaker according disposed at a certain place to an embodiment of the present invention.

FIG. 13 illustrates a speaker according to an embodiment of the present invention.

Three speakers FL, FC and FR and two speakers RL and RR may be disposed before and after a user to provide a sound effect to the user, respectively. F indicates the front of the user, and R indicates the rear of the user. C indicates center, and L and R indicate left and right. For example, FL indicates a front left speaker.

A sub woofer W may be disposed under or near a front/central speaker FC. The speaker 100 described with reference to FIGS. 1 through 10 may be used as speakers FL, FC, FR, RL, and RR.

In this case, when the speakers are the rear speakers RL and RR, sounds outputted from a sub unit do not affect a listener even when the sound is delayed by a certain time. Accordingly, when the speaker is a rear speaker, the output ratio may be set 5:5 to allow sounds to be outputted from the main unit 110 and the sub unit 120 at the same output level.

Also, when the speakers are the front speakers FL, FC and FR, sounds outputted from the sub unit 120 may be delayed by a certain time. Since the main unit is configured in plurality, it is difficult to provide a high-quality sound to a listener. Accordingly, when the speakers are front speakers FL, FC and FR, the output ratio may be set to about 7:3 such that the level of a sound outputted from the main unit 120 is higher than the level of a sound outputted from the sub unit 110.

In this case, the output level adjustment may be implemented through impedance matching with respect to a resistor connected to each speaker unit. A detailed description thereof will be described in detail with reference to the following embodiments.

Figure 14:
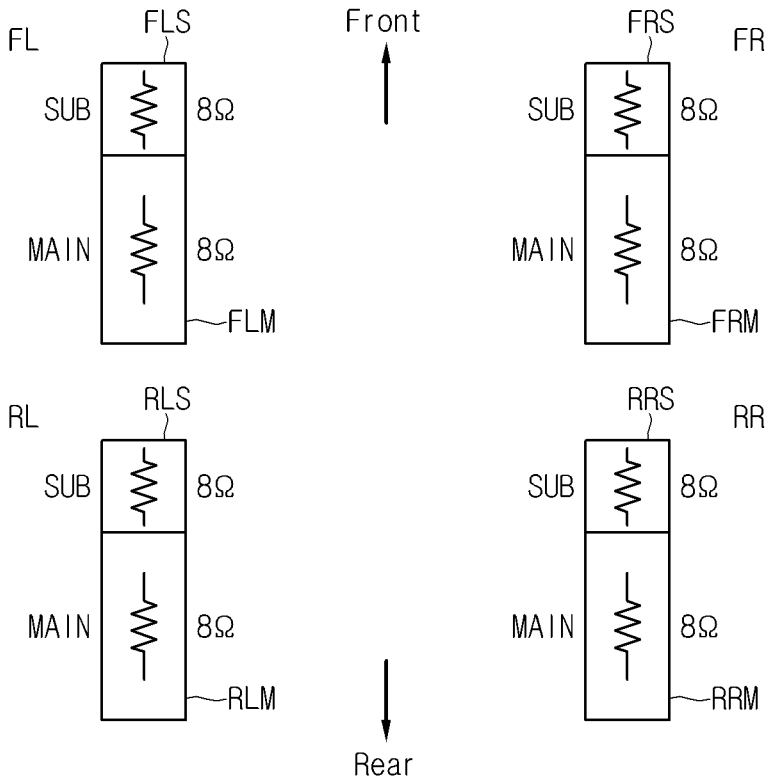
FIG. 14 is a view illustrating a speaker system according to a first embodiment of the present invention.

FIG. 14 is a view illustrating a speaker system according to a first embodiment of the present invention.

Front central (FC) speakers and a sub woofer speaker (W) are excluded from the configuration of FIG. 14. The front central speakers and the sub woofer speaker may be assigned separate channels from an amplifier.

Referring to FIG. 14, the speaker 100 described with reference to FIGS. 1 through 10 may be used as speakers FL, FR, RL and RR. The speakers FL, FR, RL and RR may be assigned one channel, respectively, and a main unit and a sub unit may output audio signals identical to each other. That is, the main unit and the sub unit may share the same channel. The main unit may output a sound in a horizontal direction, and the sub unit may output a sound in a vertical direction.

Speaker units may be expressed as three alphabet characters. The first alphabet indicates front (F) or rear (R), the second alphabet indicates left (L) or Right®, and the third alphabet indicates a main unit (M) or a sub unit (S). For example, FLS indicates a front-left sub unit, and RRM indicates a rear-right main unit.

In case of a 5.1 channel signal outputted from an amplifier (not shown) of an audio system, four channels may be assigned to speakers FL, FR, RL and RR, and the other channel may be assigned to a front-central (FC) speaker (not shown). In case of a sub woofer, while there is no channel with respect to 5.1 channel data, a separate sub woofer channel may be assigned through a frequency filter in FL and FR channels.

Figure 12:
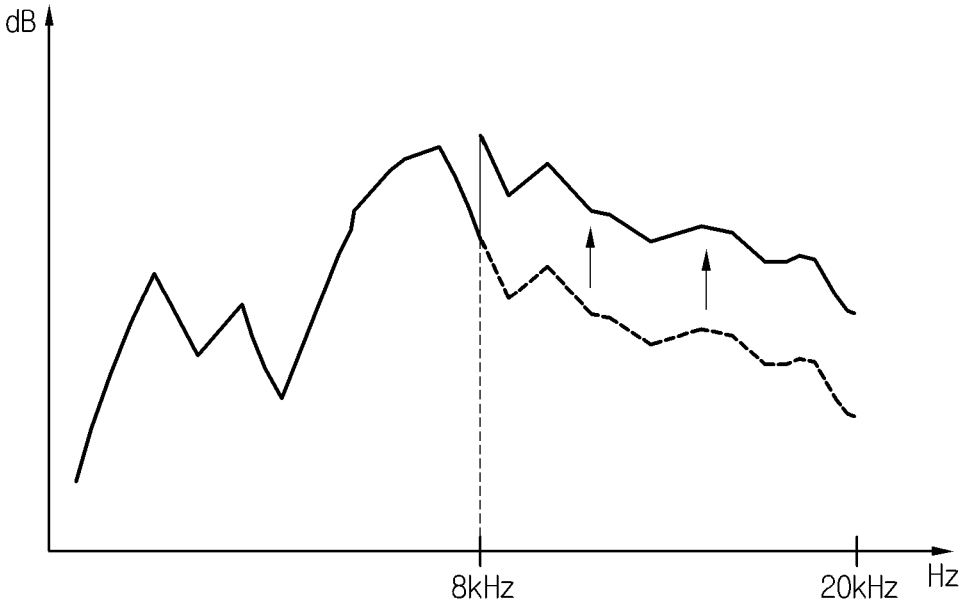

Signals transmitted to the speakers FL, FR, RL and RR and the front-central (FC) speaker may be signals to which the harmonic signal processing described with reference to FIGS. 11 and 12 has been applied or not.

Impedances of the speakers FL, FR, RL and RR have to constitute a rated resistance value for impedance matching with the amplifier. Here, it will be assumed that the resistance value is about 4Ω. For each speakers FL, FR, RL and RR, the main unit and the sub unit may be configured with about 8Ω, and, if they are connected in parallel, 4Ω. For example, FLS may be configured with about 8Ω, and FLM may be configured with about 8Ω in the speaker (FL). FLS and FLM may be connected in parallel to allow the speaker (FL) to be configured with about 4Ω.

Figure 15:
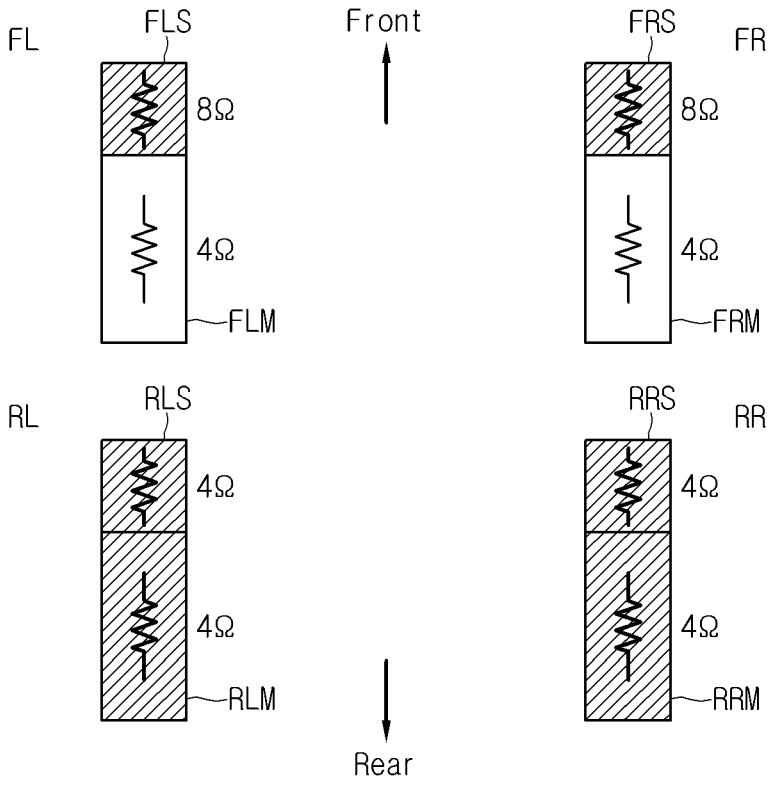
FIG. 15 is a view illustrating a speaker system according to a second embodiment of the present invention.

FIG. 15 is a view illustrating a speaker system according to a second embodiment of the present invention.

RLM, RLS, and FLS units may share one channel, and RRM, RRS, and FRS units may share one channel. That is, left shaded portions may share one channel, and right shaded portions may share one channel. That is, the main unit and the main unit of the rear speaker, and the sub unit of the front speaker may share one channel at the left and right sides, respectively. Another channel may be assigned to the main unit of the front speaker.

A signal assigned to the rear-left speaker in the 5.1 channel system, that is, a harmonic-processed signal assigned to the original RML unit may be outputted through a channel assigned to RLM, RLS, and FLS units. Also, a signal assigned to the rear-right speaker in the 5.1 channel system, that is, a harmonic-processed signal assigned to the original RRM unit may be outputted through a channel assigned to RRM, RRS, and FRS units In the 5.1 channel system, one channel may be assigned to the main units FLM and FRM of the front speaker, the units RLM, RLS and FLS, units RRM, RRS and FRS, and the main unit and the sub unit of the front-central speaker FC, respectively. In case of a sub woofer, while there is no channel with respect to 5.1 channel data, a separate sub woofer channel may be assigned through a frequency filter in FL and FR channels Through the distribution of channels, a three-dimensional effect of sound can be improved in the interior.

As described in FIG. 15, impedances of each channel may be configured with about 4Ω. The main units FLM and FRM of the front speaker that is assigned independent channels may be configured with an impedance of about 4Ω.

Figure 16:
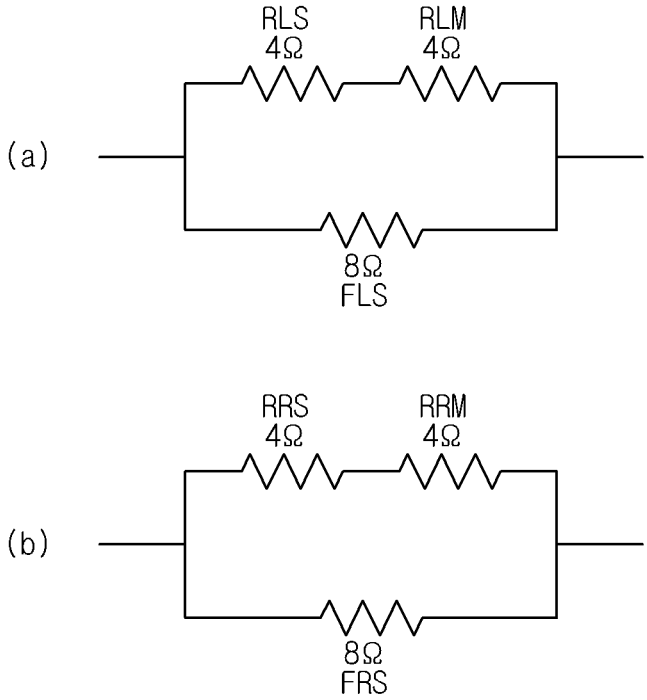
FIG. 16 is a view illustrating an impedance matching method of the speaker system according to the second embodiment of the present invention.

The left units RLM, RLS and FLS sharing one channel may be configured with about 4Ω, about 4Ω, and about 8Ω, and RLM and RLS may be connected in series as shown in FIG. 16A. Here, FLS may be connected in parallel to constitute the total 4Ω.

Similarly, the right units RRM, RRS and FRS sharing one channel may be configured with about 4Ω, about 4Ω, and about 8Ω, and RRM and RRS may be connected in series as shown in FIG. 16A. Here, FRS may be connected in parallel to constitute the total 4Ω.

Figure 17:
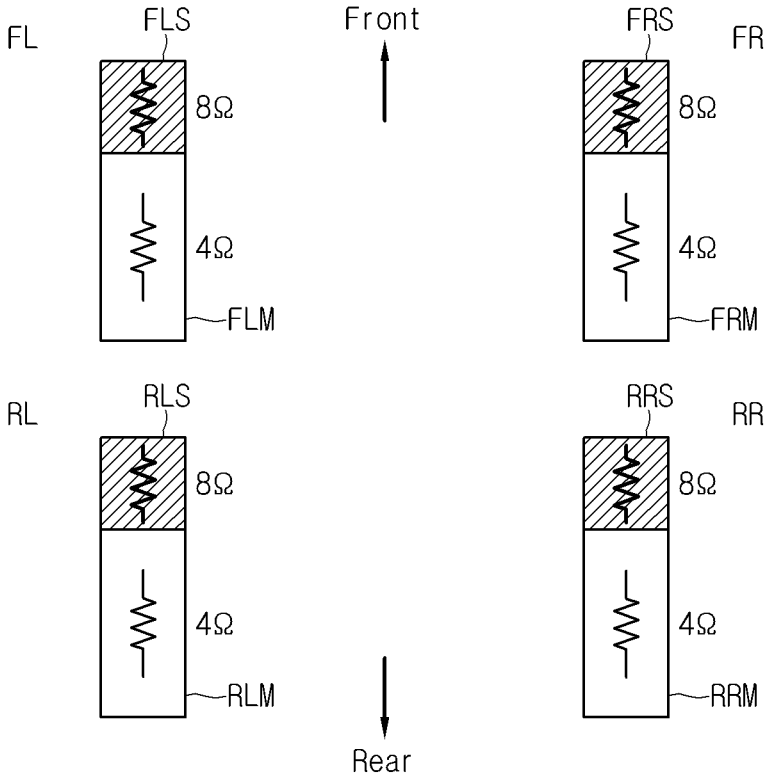
FIG. 17 is a view illustrating a speaker system according to a third embodiment of the present invention.

FIG. 17 is a view illustrating a speaker system according to a third embodiment of the present invention.

The speaker system may output 5.1 channel audio data through 7.1 channel using a harmonic signal processing.

Units RLS and FLS may share one channel, and units RRS and FRS may share one channel. That is, left shaded portions may share one channel, and right shaded portions may share one channel. That is, the sub unit of the rear speaker, and the sub unit of the front speaker may share one channel at the left and right sides, respectively. Different channels may be assigned to the main unit FLM, FRM, RLM and RRM, respectively.

Each of original 5.1 channels may be assigned to the main units FLM, FRM, RLM and RRM, and the other one channel may be assigned to the front-central speaker (FC). The main unit and the sub unit of the front-central speaker (FC) may share one channel.

A new signal that is not included in the 5.1 channel data may be generated in the other sub units, that is, the units RLS and FLS and the units RRS and FRS. Harmonic-processed signals that are outputted to the main units RLM and RRM of the rear speaker may be outputted to the respective units.

Specifically, harmonic-processed signals that are audio signals outputted to the main unit RLM of the left-rear speaker RL may be outputted to the units RLS and FLS, and harmonic-processed signals that are audio signals outputted to the main unit RRM of the right-rear speaker RR may be outputted to the units RRS and FRS.

As a result, five channels in the original 5.1 channel audio data may be provided to the main units FLM, FRM, RLM and RRM, and the front-central speaker (FC). Channels for outputting signals that are obtained by harmonic-processing signals of the main units RLM and RRM of the rear speaker may be newly generated, and the channels may be outputted to the sub unit RLS and FLS and the sub units RRS and FRS, respectively.

Figure 18:
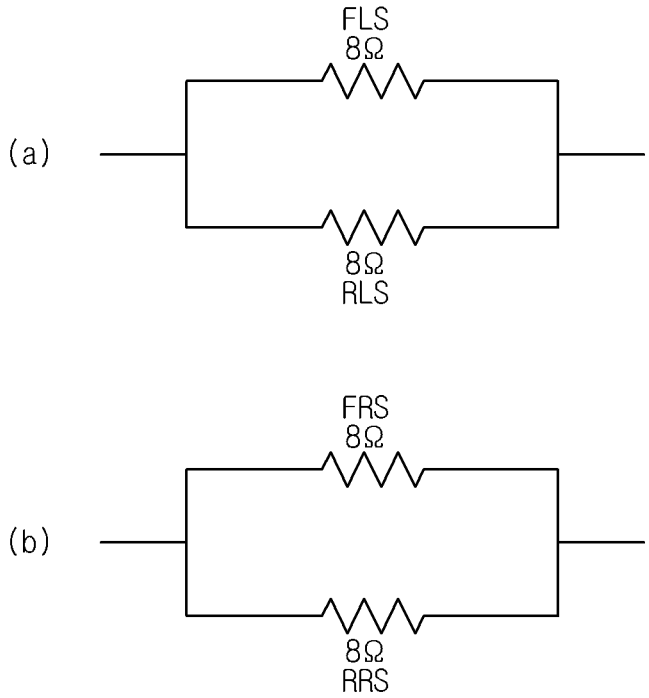
FIG. 18 is a view illustrating an impedance matching method of the speaker system according to the third embodiment of the present invention.

The sub units RLS and FLS and the sub units RRS and FRS sharing a channel may be configured with about 4Ω for impedance matching with the amplifier. As illustrated in FIGS. 18A and 18B, the sub units RLS and FLS and the sub units RRS and FRS may be configured with about 8Ω, respectively, and may be connected in parallel to each other to be configured with about 4Ω.

According to a speaker and speaker system according to an embodiment of the present invention, a sound field effect can be anticipated in consideration of the ambient environments of a listener, and a more immersive sound effect can be provided, by generating sounds having multi-directivity using one speaker.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A speaker, comprising:

a main unit outputting sound in a first direction;

a sub unit stacked on the main unit and outputting sound in a second direction, a bottom surface of the sub unit configured to be in contact with an upper surface of the main unit;

a hinge connecting a bottom edge of a side surface of the sub unit to an upper edge of a side surface of the main unit, the hinge configured to enable the sub unit to tilt with respect to a horizontal axis passing through the hinge, such that the bottom surface of the sub unit is separated from the upper surface of the main unit; and a reflection plate over the sub unit, to reflect the sound output from the sub unit to a direction different from the second direction, wherein the sub unit is configured to tilt in a range between a vertical position and a horizontal position, and wherein a level of sound from the main unit is set to be different from a level of sound from the sub unit.

2. The speaker according to claim 1, wherein the sound from the sub unit is output in a vertical direction when a bottom surface of the sub unit is in close contact with an upper surface of the main unit.

3. The speaker according to claim 2, wherein the second direction is opposite to the first direction when the sub unit is tilted to the horizontal position.

4. The speaker according to claim 2, wherein the first direction is a horizontal direction and the second direction is a longitudinal direction.

5. The speaker according to claim 1, wherein the sound from the sub unit is output in direction perpendicular to the first direction when a surface of the sub unit is in close contact with a surface of the main unit.

* * * * *